United States Patent [19]

Sando et al.

[11] 4,017,258

[45] Apr. 12, 1977

[54] METHOD OF FORMING A PRESSURE SEAL EMPLOYING AN AIR-BALANCE IN A HIGH PRESSURE STEAMER

[75] Inventors: Yoshikazu Sando; Hiroshi Ishidoshiro; Matsuo Minakata, all of Wakayama, Japan

[73] Assignee: Sando Iron Works Co., Ltd., Japan

[22] Filed: June 4, 1975

[21] Appl. No.: 583,836

[30] Foreign Application Priority Data

June 10, 1974 Japan ..... 49-65819
June 10, 1974 Japan ..... 49-65820

[52] U.S. Cl. ..... 8/149.3; 34/242; 68/5 E

[51] Int. Cl.[2] ..... D06B 23/18

[58] Field of Search ..... 8/149.3; 68/5 E; 34/15, 34/16, 51, 92, 242; 277/1

[56] References Cited

UNITED STATES PATENTS 2,873,597 .2/1959 Fahringer ..... 68/5 E
3,349,578 10/1967 Greer et al. ..... 68/5 E

*Primary Examiner*—Philip R. Coe
*Attorney, Agent, or Firm*—Toren, McGeady and Stanger

[57] ABSTRACT

A method of forming a pressure seal by employing an air balance in a high pressure steamer in which pressurized sealing gas is introduced into an air seal chamber which is shut off from the outside air by a roll seal mechanism installed at the fiber feed in and take out openings of a high pressure steamer vessel body, so that the sealing gas and steam leaking from within the vessel body into the air seal chamber buffer each other for forming and air balance within the vessel body.

2 Claims, 9 Drawing Figures

METHOD OF FORMING A PRESSURE SEAL EMPLOYING AN AIR-BALANCE IN A HIGH PRESSURE STEAMER

BACKGROUND OF THE INVENTION

The present invention relates to a method for forming a pressure seal for the fiber product feed in and take out parts provided in a high pressure steamer.

Heretofore, a method for forming pressure seal in a high pressure steamer has had such shortcomings that steam being under pressure into the vessel body of a high pressure steamer is heated to have high temperature during operation making it difficult to retain the atmosphere (pressure, temperature, etc.) of the steam at a state suitable for processing fiber products, further the temperature within vessel body rises to the high temperature of the steam causing thermal expansion to take place at each sealing member of the seal device of the steamer, moreover, as the coefficient of thermal expansion of each of the seal members is different each sealing member is placed in pressure contact with the other by great pressure with the sealing gas under high pressure within the vessel chamber affecting strain deformation, causing pressure seal leakage and thus lowering the safety of operation, furthermore, the durable life of the seal apparatus is shortened, and the time, trouble and expenses required for maintenance of the apparatus increase, also adversely affecting operating efficiency.

Pressure seal apparatus for the fiber product feed in and take out parts of a high pressure steamer vessel body used in a conventional pressure sealing method ordinarily has such method as providing a roll seal mechanism consisting of such sealing members as a pair of left and right seal rolls rotating in contact with each other, a seal block installed at the fiber feed in and take out openings of vessel body, and intermediate rolls intervening between the seal rolls and the seal block, etc.

However, in a sealing apparatus having said set-up, the temperature within steamer vessel body rises during operation as mentioned above and each sealing member of said sealing apparatus directly receives the effect of high temperature which causes thermal expansion, resulting in strain deformation at each sealing member in contact with the other because of their coefficients of thermal expansion being different and causing pressure seal leakage, thereby it becomes difficult to retain the atmosphere of steam pressure introduced into vessel body at such a constant state as is suited for processing the fiber products, and the elastic substance for seal rolls becomes fragile because of defects of a mechanism to adjust change in the atmosphere, etc., thereby shortening the durability life of the seal apparatus.

Furthermore, in a seal apparatus having above mentioned mechanism the pressure contact points between a pair of left and right seal rolls and the sealing member which pressure contacts with circumferential surface of the rolls, that is, the pressure sealing points in the circumferential direction of said rolls are such that the nip planes formed by the seal rolls form almost right angle against the axial centers of the rolls, therefore the seal roll circumferential plane receiving the pressure within the vessel is great and the pressure giving force over seal roll required for formation of nip plane needs to be comparatively large. Therefore, the driving force for such seal rolls becomes large, and further the effect on fiber products passing through nip plane also increases.

The object of the present invention is to prevent various shortcomings generated in this conventional method and by providing a pressure seal method employing air balance in a high pressure steamer embody said method, and realized a method and an apparatus in which pressure seal operation is done safely and surely, and the roll seal mechanism of seal apparatus used will not be directly affected by high temperature thereby providing any fear of deformation and securing a long durable life.

SUMMARY OF THE INVENTION

An object of the present invention is to provide a pressure seal method employing air balance of a high pressure steamer with sealing gas being pressure introduced into an air seal chamber, which is shielded from outside air and is provided between a roll seal mechanism installed at a fiber product feed in and take out openings of a high pressure steamer vessel body and inside the vessel body, to have the gas buffered with steam leaking from the vessel body into the air seal chamber to form air balance for doubly preventing leakage of high pressure steam within the vessel body, and further, when the inside temperature of vessel body reaches a high level the high temperature inside the vessel body will not affect the roll seal mechanism of the seal apparatus.

The present invention provides a pressure seal apparatus employing air balance of a high pressure steamer which consists of an air seal chamber being shielded from outside air by a roll seal mechanism installed at the fiber feed in and take out openings of a high pressure steamer vessel body, a sealing gas pressure introduction mechanism installed near the above mentioned roll seal mechanism for dividing the inside of the above mentioned air seal chamber into a plural number of sections along a route for transferring fiber products, to form small gas chambers, and connecting an exhaust tube for exhausting mixed gas of pressure sealing gas and steam leaking out of the vessel body at least to a small chamber in which the sealing gas and the steam collide and mix with each other out of the small chambers, further for pressure introducing the sealing gas into the air seal chamber, a detector to detect the condition of the steam, that is the temperature or humidity within each of the small chambers, and an air supply volume automatic regulator provided to regulate pressure supply volume of sealing gas comparing the value detected by said detector and a predetermined value.

In order to overcome such disadvantageous conditions in structure as that (1) the pressure at the circumferential plane of the seal roll increases, (2) the pressure applying force to the seal roll required for formation of nip plane becomes comparatively a strong, and (3) strong seal roll driving force will be required, etc., which take place in the conventional pressure seal apparatus mentioned above, in the pressure seal apparatus employed in the method of the present invention a hollow elastic sealing member having a fiber product passage and forming an arc shape external part is fixedly provided at an plane of the seal block, and a pair of left and right seal rolls are provided in close contact with the arc shape external plane so that the pressure contact position of the sealing member and the seal roll is made closer to the nip, reducing the pressure receiving plane of the seal roll against the vessel internal pressure for reducing the pressure given to the seal roll required for formation of the nip plane, and at the same time the vessel internal pressures is utilized for applying the seal roll into pressure contact with the sealing member so that the sealing member is in pressure contact with the circumferential plane of the seal rolls.

BRIEF DESCRIPTION OF THE DRAWINGS

The drawings show examples of a pressure seal apparatus employing air balance according to the present invention, wherein.

DESCRIPTION OF THE PREFERRED EMBODIMENTS

Figure 1:
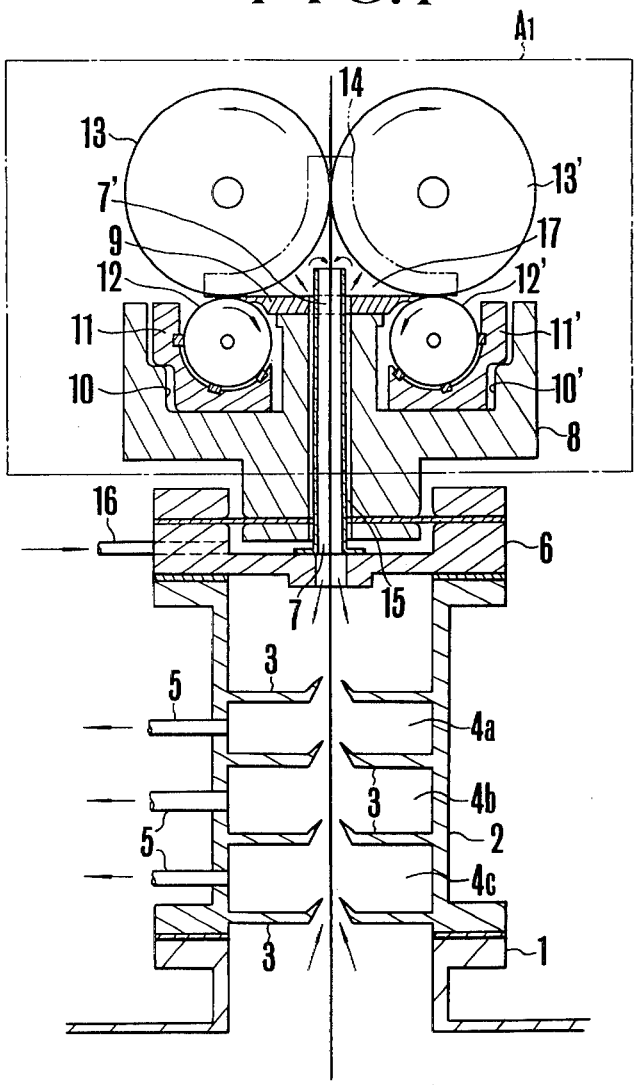
FIG. 1 is a vertical cross section to show a set-up of Example 1, FIG. 2(*a*) is a vertical cross section showing a set-up of Example 2, FIG. 2(*b*) is a drawing for installation of seal belt, and FIG. 2(*c*) shows a partially enlarged oblique view to show structure of seal belt.

Details of a pressure seal apparatus employing air balance according to the present invention will be explained in reference to examples shown in the drawings.

EXAMPLE 1

In FIG. 1, 1 is a flange part formed at a fiber product inlet and outlet opening at a high pressure steamer vessel body, and 2 is a tube wall with its lower end fixed to the flange part to form an air seal chamber being shielded from external or outside air by a roll seal mechanism $A_1$ (shown by chain line in the drawing) which is installed at its upper end, and this air seal chamber is divided into a plurality of small gas rooms 4*a*, 4*b*, 4*c* along a fiber products transfer passage by a plurality of dividing walls 3 protrudingly provided at both sides of the passage in such manner as forming almost a right angle with the passage. 5 shows an exhaust tube connected to each of above mentioned small gas rooms 4*a*, 4*b*, 4*c* and 6 is a supporting member, flexibly supporting the roll seal mechanism $A_1$ against the tube wall 2.

The above mentioned roll seal mechanism $A_1$ consists of a seal block 8 having a fiber products passage 7, a flat plane seal liner 9 installed at the upper plane of the seal block 8 and having a fiber products passage 7', a pair of left and right intermediate rolls 12 12' which are rotatably supported on supporting stands 11 11', respectively within concave parts 10 10' formed at both sides of the fiber products passage 7 which goes through the seal block 8 and are in pressure contact with both side planes of the above mentioned flat plane seal liner 9 respectively along the circumferential plane, a pair of left and right seal rolls 13, 13' which rotate in pressure contact with the intermediate rolls 12, 12' respectively also in pressure contact with each other, and an end plane seal plate 14 which is in pressure contact with the end planes of the seal rolls 13, 13', the circumferential planes of intermediate rolls 12 12' and with the upper plane of the flat plane seal liner 9. 15 shows a sealing gas passage provided at the fiber products passages 7, 7' of the seal block 8, wherein its lower end is connected with a gas pressure introduction device (not shown in the drawing) at the outside through a sealing gas pressure introduction tube 16 connected wih the above mentioned supporting member 6, while its upper end is opened to the space 17 enclosed by the pair of left and right rolls 13, 13', the flat plane seal liner 9 and the end plane seal plate 14.

For conducting pressure sealing employing air balance using a sealing apparatus with the above mentioned set-up, when sealing gas is introduced under pressure from the sealing gas pressure introduction tube 16, the gas flows into the space 17 through the passage 15 and is further introduced into the air sealing chambers 4 within the tube wall 2 through the fiber products passages 7 7'.

On the other hand, steam leaking out of the vessel body comes up to near the lower end of the air seal chambers. Therefore, when the amount of sealing gas introduced under pressure is suitably determined corresponding to the inner pressure of the vessel body, each of the above mentioned small gas chambers within the tube wall 2 forms the atmosphere of a sealing gas chamber 4*a*, a mixed gas chamber 4*b* and a steam chamber 4*c* respectively in that order downwardly from the roll seal mechanism $A_1$ side, thus they can form as a whole an air balance between the sealing gas and the steam within vessel body.

Also since the gas in each of the small gas chambers 4*a*, 4*b*, 4*c* are exhausted through the exhaust tubes 5 as its exhaust amount is regulated, the atmosphere or conditions of the steam within the vessel body can be retained constant as there is no leakage in pressure seal from other parts.

According to experimentation tests conducted the above mentioned apparatus, since the air-tightness of vessel body by combined use of the roll seal and air balance seal was enhanced and the amount of steam exhausted from the air balanced part could be easily adjusted, the fiber products could be processed in a state under which atmosphere within the vessel body was retained constant, thus such effects were realized that the loss of heat was prevented, processing time was shortened and quality of products was enhanced.

When low temperature air was used as sealing gas in the above mentioned experimentation tests each of small gas chambers 4*a*, 4*b*, 4*c* within tube wall 2 was kept in a state of such air balance as showing a distribution of gradual lowering of temperature from the vessel body side to the roll seal mechanism $A_1$, therefore, the high temperature within the vessel body did not affect directly the roll seal mechanism $A_1$ and thermal expansion of each seal member was reduced, while the elastic material used in the seal rolls 13 13' could be prevented from becoming fragile.

EXAMPLE 2

Figure 2B:
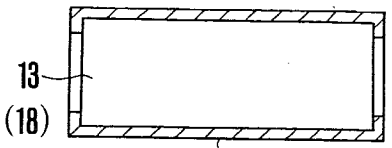
Figure 2C:
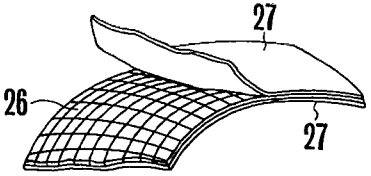
Figure 2A:
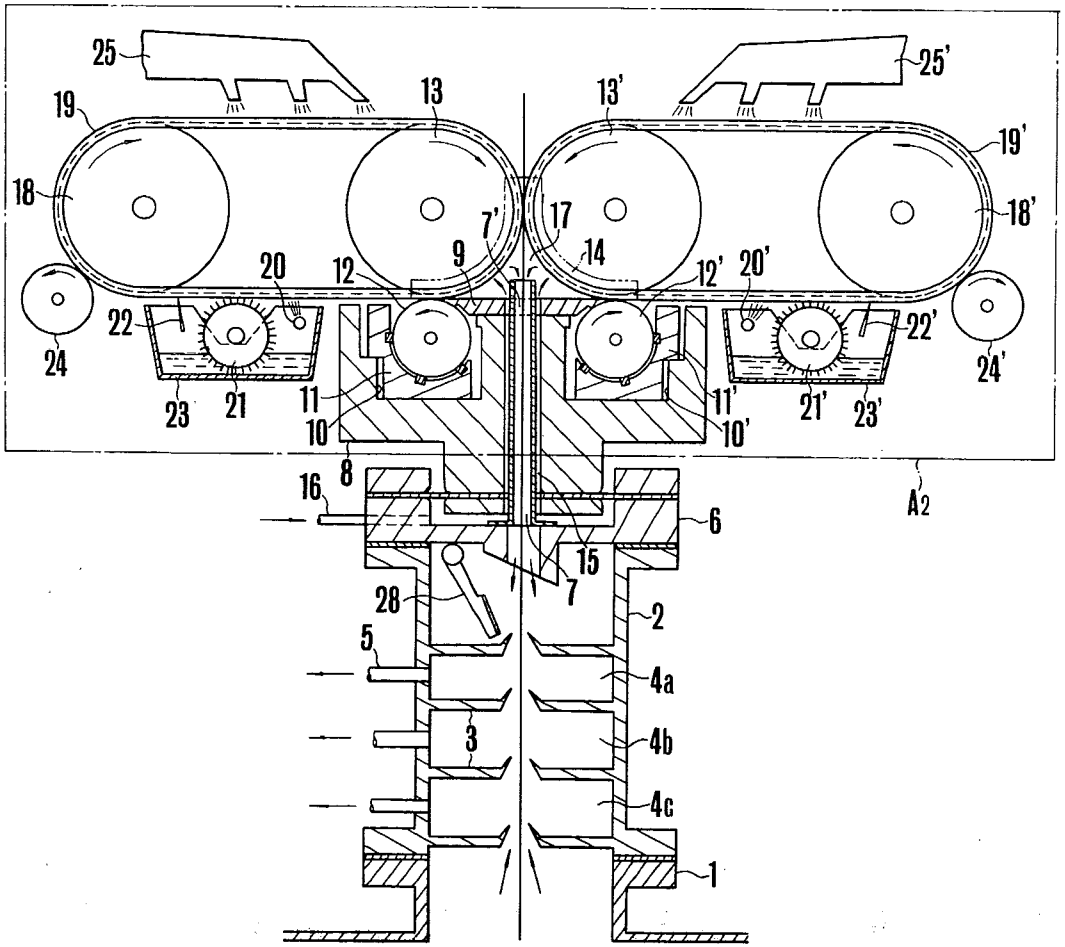

In this example as shown in FIG. 2(*a*) the roll seal mechanism $A_2$ (shown by chain line) flexibly supported against the tube wall 2 is so made that a pair of left and right seal rolls 13 13' and rolls 18 18' corresponding to each of the seal rolls respectively, and left and right seal belts 19 19' respectively placed around each group of the rolls 13, 18 and of 13', 18' which oppose to each other in left and right are provided, and that the pair of left and right seal rolls 13, 13' form a nip plane through the seal belts 19, 19', also in the revolving process of the seal belts 19, 19', after leaving the nip plane, washing boxes 23, 23' consisting of shower pipes 20, 20', brush rolls 21, 21' and adjusters (doctors) 22, 22' having function of cleaning and removing foreign matter adhering on the belts 19, 19', followed a water squeezing rolls 24, 24' and dry boxes 25, 25' for drying and cooling the surfaces of the seal belts 19, 19' are positioned in series arrangement order along the revolving direction of the belts 19, 19'.

The above mentioned seal belts 19, 19' have such shape that at least a single layer of expandable net 26 is sandwiched by upper and lower elastic bodies 27 for the prevention of thermal expansion and damage as shown in FIG. 2(*c*).

28 shows a safety valve which is installed in a rotatable state to the under plane of the supporting member 6 and can contact with the supporting member 6 by its own rotation and can shield the fiber products passage 7 from the air seal chambers, 4*a*, 4*b*, 4*c* and is made to react in case the steam within vessel body generated as the roll seal mechanism $A_2$, etc. has defects suddenly flowing towards the roll seal mechanism $A_2$ side.

Since other structures of this apparatus is same as the one shown in Example 1, explanation thereof will be omitted.

When pressure seal is made employing air balance by the seal apparatus with the above mentioned set-up, since nip plane at the roll seal mechanism can be formed at any part of the total length of the seal belts 19, 19', therefore the durability life of the roll seal mechanism can be made much longer, further there is the convenience of easily exchanging and replenishing the seal belts 19, 19'.

Furthermore, since the seal belts 19, 19' have one layer or more of expandable net 26 inserted at their center layer portion, the thermal expansion is remarkably reduced, and as treatment, such as cooling, is done in the course of its revolving the pressure seal leakage due to the effect of heat within the roll seal mechanism $A_2$ forming the nip plane through the seal belts 19, 19' will be remarkably reduced. Therefore, the air-tightness of steam within the vessel body will be much enhanced as mentioned previously.

Further, when there occurs any defects in the roll seal mechanism $A_2$ the above mentioned safety valve 28 functions to shield the connection between the fiber products passage 7 and the air seal chamber within the tube wall 2, having the effect of preventing leakage of steam in the vessel body.

EXAMPLE 3

Figure 3:
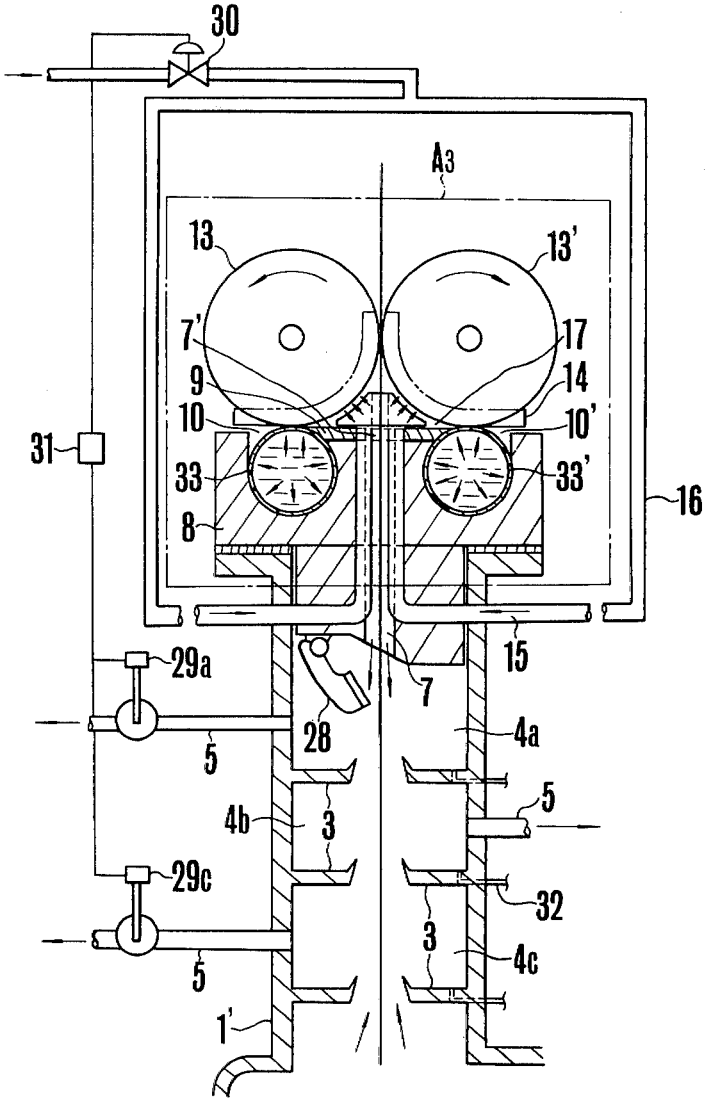
FIG. 3 is a vertical cross section to show set-up of Example 3.

In the pressure seal apparatus of this example as shown in FIG. 3 a flange part 1' protrudingly provided at a fiber products feed in and take out opening of a vessel body is extended to form an air seal chamber, and a roll seal mechanism $A_3$ is installed at the upper end of the same.

Inside of the flange part 1' is divided into a plurality of small gas chambers 4*a*, 4*b*, 4*c* along the fiber products transferring passage by dividing walls 3 protrudingly provided at almost right angles with the passage as shown in the Example 1, and exhaust tubes 5 are connected to each of the small gas chambers 4*a*, 4*b* and 4*c*.

Temperature detectors 29*a*, 29*c* to detect the temperature (or humidity) of exhaust gas are installed respectively in each of the exhaust tubes connected to the sealing gas chamber 4*a* and steam chamber 4*c* of the above mentioned exhaust tubes, and signal output terminals of the detectors 29*a*, 29*c* are connected to a converter 31 which compares the output signals and pre-set valves to activate a pressure supply amount regulating valve 30 for sealing gas.

32 is a drain remover to exhaust drain piled up on the surface of the dividing walls 3.

Also in the above mentioned roll seal mechanism $A_3$, water permeable hoses 33, 33' are inserted, respectively, into concave parts 10, 10' at both sides of the fiber products passage 7 which is opened to the upper plane of the left and right seal block 8, and a pair of seal rolls 13, 13' are opposedly provided in such manner that they make close contact with the hoses along their circumferential surface when water is supplied under pressure to the hoses 33, 33'.

A process of forming air balance by the sealing gas in each of small gas chambers 4*a*, 4*b*, 4*c* within the flange part 1' and the steam leaking out of the vessel body into flange part 1' when pressure seal is done using the above mentioned apparatus will be same as that in the apparatus of Example 1 mentioned before. And when there is a variation in the air balance for example the buffering position of the two kinds of gaseous material changes by an increase or decrease in the internal pressure in the vessel body, the temperature detected by the temperature detectors 29*a*, 29*c* changes and as the converter 31 detects the temperature change, the regulating valve 30 is activated to adjust the amount of pressure supply of the sealing gas so that the air balance is always retained in a constant state.

That is, when steam goes up to the roll seal mechanism $A_3$ side the temperature change detected by the detector 29*a* is detected by the coverter 31 to activate the regulating valve 30, thereby the pressure of the sealing gas is increased, while contrary to this as the sealing gas comes down to the vessel body side, the temperature change detected by the detector 29*c* is detected by the converter 31 to activate the regulating valve 30 again, thus reducing the pressure of the sealing gas.

Also the temperature detectors 29*a*, 29*c* can be so installed for directly detecting the temperature in each of the small gas chambers.

EXAMPLE 4

Figure 4:
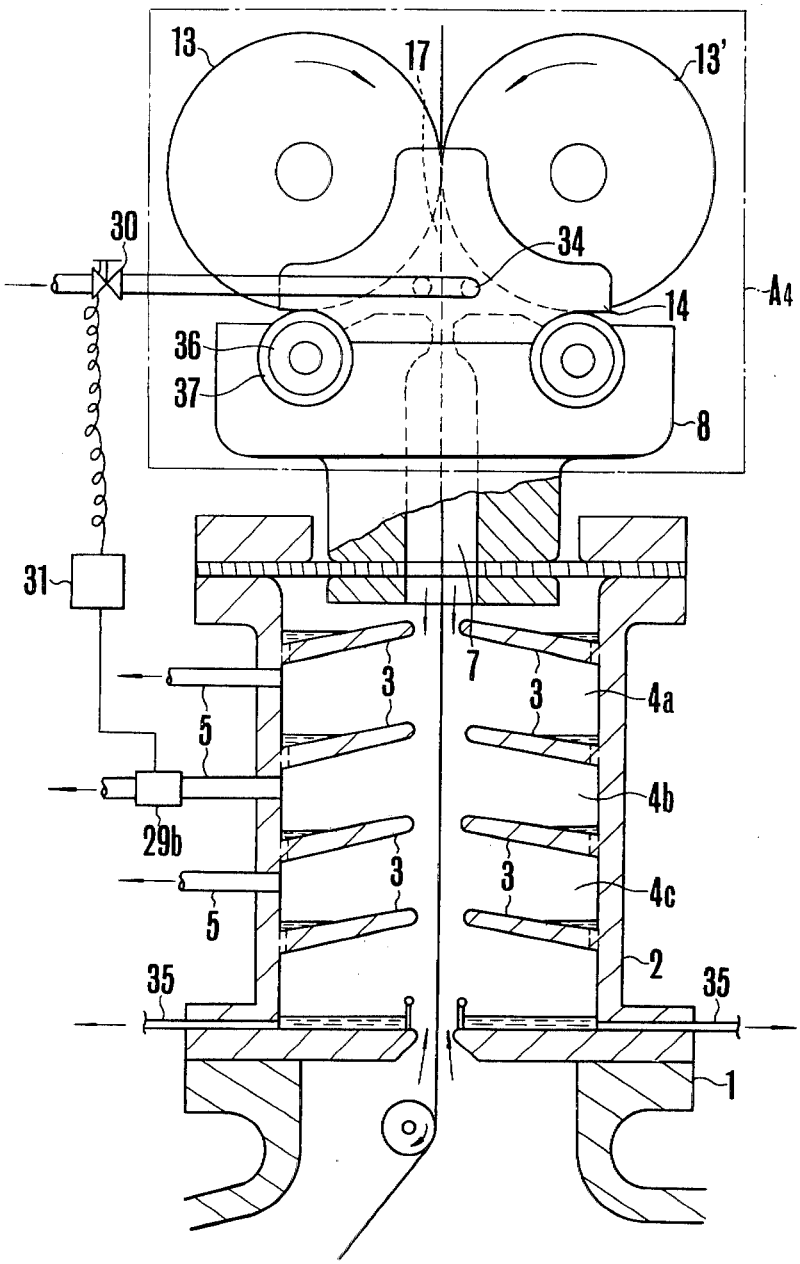
FIG. 4 is a vertical cross section to show set-up of Example 4.

In the apparatus of this example as shown in FIG. 4, sealing gas is supplied under pressure at inlet 34 provided in an end plane sealing plate 14 into a space 17 enclosed by a pair of left and right seal rolls 13, 13' of a roll seal mechanism $A_4$, a seal block 8, and the end plane sealing plate 14. Further, liquid stagnating on the surfaces of plurality of dividing walls 3 forming a plurality of small gas chambers 4*a*, 4*b*, 4*c* along the fiber products transferring passage within the tube wall 2 is removed by a drain remover 35 provided at the lower end of the tube wall 2 through internal wall surface of said tube wall 2.

Next, for temperature detection within the air seal chamber necessary for always retaining the air balance in a constant state, a temperature detector 29*b* is provided at an exhaust tube 5 connected to the small gas chamber 4b to detect the temperature of mixed gas being exhausted out of the small gas chamber 4b.

In the roll seal mechanism $A_4$ in this example, a pair of left and right intermediate rolls 37, 37' are rotatably provided, at concave parts 10, 10' provided at both sides of a fiber products passage 7 which is opened to upper plane of the seal block 8, in such manner as slidingly fitted with the concave parts 10, 10' respectively, and cooling water passages 36, 36' are formed in the intermediate rolls extending in their inner axial direction. And a pair of left and right seal rolls 13, 13', which pressure contact with the intermediate rolls 37, 37' respectively and also rotate in contact with each other, are provided, and when the above mentioned roll seal mechanism is activated water forms a dew at the surface of the intermediate rolls 37, 37' by cooling water flowing through the cooling water passage formed inside of the intermediate rolls 37 37', so that the rotation of the seal rolls 13, 13' is lubricated.

When the pressure seal employing air balance is done using the apparatus with the above mentioned set-up, since sealing gas is to be directly forced into the inside of the roll seal mechanism $A_4$ through the end plane sealing plate 14, it is not necessary to form a sealing gas passage at a fiber products passage 7 of the seal block 8, thus the roll seal mechanism is of such a set-up as being able to use a conventional type mechanism without modification, therefore, the tube wall 2 and the temperature detector 29b etc. illustrated in this example can be installed into a pressure seal apparatus of an existing high pressure steamer vessel body.

EXAMPLE 5

Figure 5:
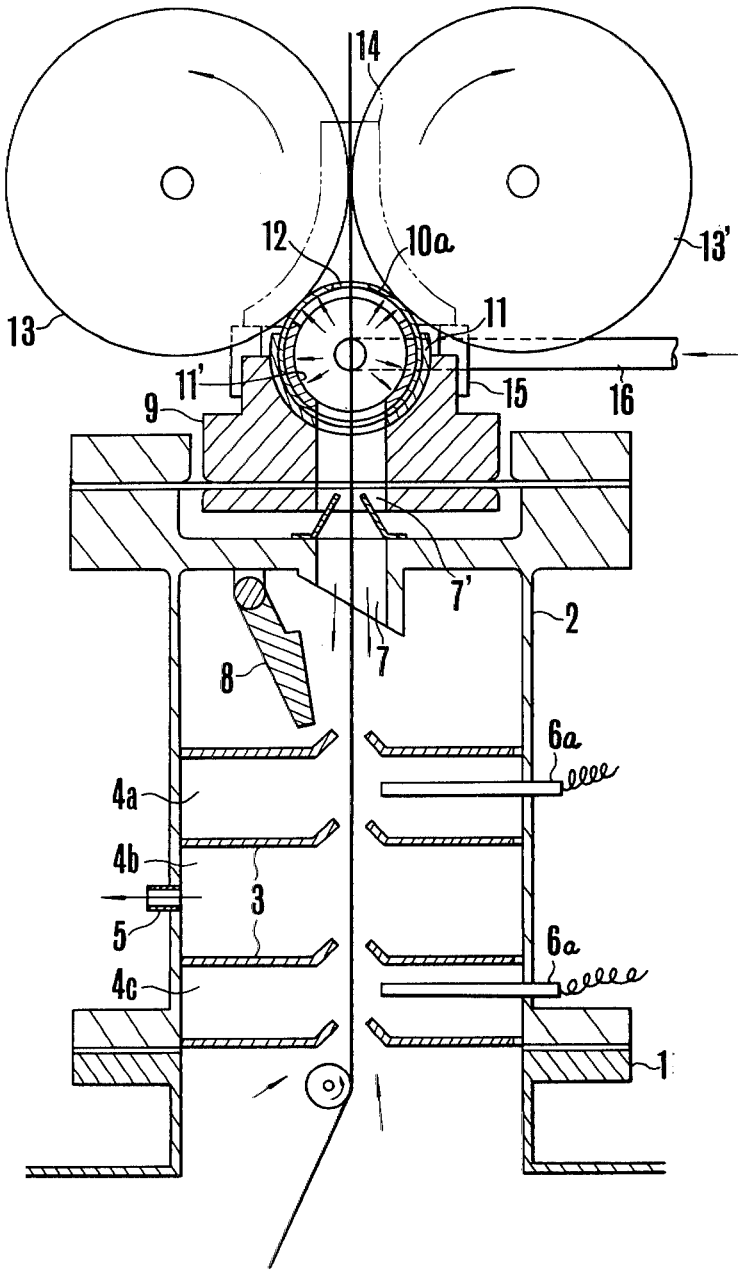
FIG. 5 is a vertical cross section to show set-up of Example 5.

An apparatus of this example has, as shown by FIG. 5, a fiber product outlet flange part 1 of a high pressure steamer vessel body, and a tube wall 2 installed on the flange part (1) forms a plurality of small gas chambers 4a, 4b, 4c divided by dividing walls 3 along a fiber products transfer passage, and each of the small gas chambers of the tube wall 2 forms a separate atmosphere, that is a sealing gas chamber 4a, a mixed gas chamber, and a vapour chamber 4c for buffering the sealing gas pressure supplied from upper direction and the vapour leaking into the vessel body, thus forming an air seal as a whole, further, an exhaust tube 5 is connected to the mixed gas chamber 4b while temperature detectors 6a are provided at the sealing gas chamber 4a and the vapour chamber 4c. And a safety valve having the function of tightly closing the fiber products passage 7 is provided at the inside of the upper end of the tube wall (2).

Figure 6:
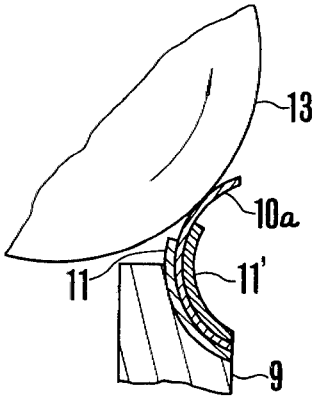
FIG. 6 is a cross section in enlargement of an important part of FIG. 5 showing the state in which a sealing member is intervened between the seal block and the seal rolls.
Figure 7:
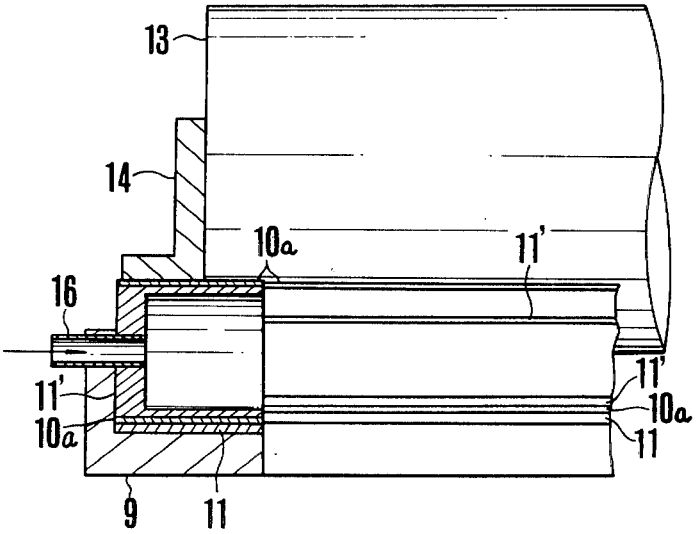
FIG. 7 is a side cross section to show in enlargement the state in which each member shown in FIG. 6 including air pressure inlet tube is so positioned as pressure contacting with each other.

The seal block 9 shown in enlargement in FIG. 6 is flexibly supported at the upper end of the tube wall 2 through a diaphragm packing 10a and a fiber products passage 7' is formed therein. The diaphragm packing 10 is a tubular shaped elastic sealing member with both ends closed and attached to upper plane of the seal block 9 by fixing metal fittings 11 11' in such manner as using the fiber products transfer passage as a diameter and having a fiber products passage 12 thereon.

13, 13' are a pair of left and right seal rolls rotating in close contact with the circumferential surface of the above mentioned tubular shaped elastic material at both sides of the fiber products transfer passage and in contact with each other. 14 is an end plane sealing plate which is in pressure contact with the end planes of said seal rolls 13, 13' and with the circumferential plane of the above mentioned sealing member 10a. A supporting member 15 is fixed to the seal block 9 for slidably supporting the end plane sealing plate 14, and a sealing gas pressure supply tube 16 is connected to inside of the tubular sealing member 10 for supplying pressurized sealing gas.

When a pressure seal apparatus with the above mentioned set-up is used, the tubular shaped elastic sealing member 10 is in pressure contact with the circumferential planes of the seal rolls 13, 13' by sealing gas pressure supplied by the pressure supply tube 16, and the pressure contacting state is further tightened by the elasticity of the sealing member, thus a pressure seal in the circumferential direction of the seal rolls 13, 13' is formed. Furthermore, the above mentioned pressure sealing position is in such a positional relationship of almost 45° with the nip plane for the axial center of the seal rolls 13, 13', therefore, the pressure receiving plane for internal pressure of the seal rolls 13, 13' is halved compared to conventional applying pressure seal apparatus, and the pressure force to the seal rolls 13, 13' having the function of providing the necessary nip width to the nip plane, is remarkably reduced.

While this example shows a pressure seal apparatus at a fiber products outlet side, wherein there is no fear at all of the tubular shape elastic sealing member 10, which has a fiber products passage 12 in a rotating direction of the seal rolls 13, 13', being bitten into by the rotation of said seal rolls 13, 13', even in a pressure seal apparatus at inlet side which is not shown in the drawing, the above mentioned elastic sealing member 10 is so formed as warping against the circumferential direction of the seal rolls 13, 13' and is connected at both ends sides of fiber products passage 12 and forms a tubular shape, generating such supporting force as being able to resist against being bitten in by the rotation of the seal rolls 13, 13' with said shape. Therefore, when the coefficient of elasticity of the above mentioned tubular shaped elastic sealing member 10 is suitably selected, bite-in accidents by the rotation of seal rolls 13, 13' can be prevented.

As explained in the above mentioned Examples 1 to 5, a pressure seal method employing air balance in a high pressure steamer according to the present invention have such set-up that the sealing gas is supplied under pressure into an air seal chamber and is shielded from outside air by the roll seal mechanisms installed at fiber products feed in and take out openings of a high pressure steamer vessel body, wherein the sealing gas and steam leaking from the vessel body into the air seal chamber are made to buffer each other to for providing air balance, and the air-tightness within the vessel body is remarkably enhanced compared to that in a conventional pressure seal apparatus, making it easy to retain atmosphere or conditions within the vessel body at a constant state while the fiber products are processed. Particularly in the apparatus shown in Example 5, the pressure receiving plane of the seal rolls against the internal pressure within the vessel body is remarkably reduced, and based on the reduction of pressure giving force required for providing the necessary nip width on the nip plane formed by the above mentioned pair of left and right seal rolls and on the reduction of frictional resistance of the seal rolls, driving power energy is saved and the operating cost is lowered, further, there is such great practical advantages that loss of heat becomes nil, yet processing time is shortened, the quality of the product processing is improved, further the effect on the fiber product passing through the nip plane of the seal rolls is reduced, etc.

Furthermore when low temperature air is used as sealing gas such advantages are added that the effect over the roll seal mechanism by high temperature within vessel body is remarkably lowered and the durable life of the seal rolls, etc using elastic material is extended, etc.

What is claimed is:

1. A method of providing a pressure seal for the fiber feed-in and the take-out openings in a high pressure steamer vessel body in which the fiber is treated, comprising steps of providing a roll seal mechanism at the feed-in and take-out openings, forming a tubular chamber for each of the roll seal mechanisms with the tubular chamber open at one end to the roll seal mechanism and at the other end to the interior of the steamer vessel body wherein the fiber is treated, dividing the interior of the tubular chamber into at least three serially arranged intercommunicating sub-chambers with a first sub-chamber being closest to the roll seal mechanism, a second-sub-chamber being closest to the interior of the steam vessel body and a third sub-chamber being positioned between the other two, supplying a pressurized sealing gas at a pressure corresponding to the pressure within the steam vessel body into the first sub-chamber, admitting steam from the interior of the steamer vessel body into the second sub-chamber, and intermixing the sealing gas and the steam in the third sub-chamber for forming a sealing gas zone in the first sub-chamber, a steam zone in the second sub-chamber and a mixed gas zone in the third sub-chamber.

2. A method, as set forth in claim 1, comprising the further step of using a low temperature pressurized gas as the sealing gas in comparison to the temperature of the steam within the steamer vessel body, and flowing the low temperature sealing gas over the roll seal mechanism.

* * * * *